US007469523B2

(12) United States Patent
Hussey

(10) Patent No.: US 7,469,523 B2
(45) Date of Patent: Dec. 30, 2008

(54) SUPER STIRRUP

(76) Inventor: Charles Hussey, 15A Wellington Drive, St. Andrew (JM)

( * ) Notice: Subject to any disclaimer, the term of this patent is extended or adjusted under 35 U.S.C. 154(b) by 0 days.

(21) Appl. No.: 11/434,492

(22) Filed: May 15, 2006

(65) Prior Publication Data

US 2007/0169443 A1 Jul. 26, 2007

(30) Foreign Application Priority Data

Jan. 26, 2006 (JM) ..... 18/1/4417

(51) Int. Cl.
*B68C 3/00* (2006.01)

(52) U.S. Cl. ..... 54/47

(58) Field of Classification Search ..... 54/47–48
See application file for complete search history.

(56) References Cited

U.S. PATENT DOCUMENTS

| | | | | | |
|---|---|---|---|---|---|
| 112,652 | A | * | 3/1871 | Taylor | 54/48 |
| 259,101 | A | | 6/1882 | Cox | |
| 261,733 | A | * | 7/1882 | Larcom | 54/47 |
| 264,560 | A | * | 9/1882 | Parker | 54/49.5 |
| 269,035 | A | * | 12/1882 | English | 54/49 |
| 295,423 | A | | 3/1884 | Philbrook | |
| 313,484 | A | | 3/1885 | Ellacott | |
| 594,926 | A | * | 12/1897 | Anderson | 54/49 |
| 779,476 | A | | 1/1905 | Hayden | |
| 901,908 | A | * | 10/1908 | Johnson | 54/49 |
| 931,607 | A | | 8/1909 | Hooks | |
| 939,697 | A | | 11/1909 | James | |
| 970,664 | A | | 9/1910 | Swart | |
| 1,074,481 | A | | 9/1913 | Ward | |
| 4,881,303 | A | | 11/1989 | Martini | |
| 5,172,538 | A | | 12/1992 | Luger | |
| 5,390,478 | A | | 2/1995 | Holsworth | |
| 5,398,488 | A | | 3/1995 | Brown | |
| 5,930,986 | A | | 8/1999 | Meaghan et al. | |
| 6,513,309 | B1 | | 2/2003 | Morgante | |
| 6,865,867 | B1 | | 3/2005 | Zucchini | |
| 6,925,786 | B2 | | 8/2005 | Sjosward | |

FOREIGN PATENT DOCUMENTS

| | | |
|---|---|---|
| GB | 1 474 192 | 5/1977 |
| GB | 2 274 381 | 7/1994 |

* cited by examiner

*Primary Examiner*—Son T. Nguyen
(74) *Attorney, Agent, or Firm*—Storm LLP; Mark D. Perdue

(57) ABSTRACT

Until recently, stirrups have not provided adequate support for a rider allowing for ease of balance when riding, and especially while racing. The super stirrup described herein provides a stable platform or base accompanied by a number of support bars that allow the rider to rest and reposition his or her weight easily. Thus, the super stirrup improves the performance of a rider in both leisure and sport riding.

14 Claims, 4 Drawing Sheets

SUPER STIRRUP

CLAIM OF PRIORITY

This application claims priority from Jamaican Patent Application No. 18/1/4417 entitled "SUPER STIRRUP" filed on behalf of Charles Hussey, on Jan. 26, 2006, which is hereby incorporated by reference for all purposes.

TECHNICAL FIELD

The invention relates generally to a stirrup and, more particularly, to an improved form of stirrup iron for use in horse racing and related activities, including training.

BACKGROUND

Beginning with a simple loop or ring with a flat bottom to create a footrest for the rider and to enable him/her to mount an animal, stirrups have been around for centuries.

The modern-day stirrup iron for horse-riding essentially comprises a horizontal base or flat bottom, joined by two bars on either side of the base running vertically and being angled towards the top where there is a stirrup strap hole. These components are described herein as the frame of the stirrup. See FIGS. 1A-1C for the basic stirrup frame. The stirrup strap hole is a gap for the placement of the belt connecting the stirrup to the saddle. The stirrup iron commonly used by jockeys is shown in FIGS. 1D-1F.

Variations occur in the size of the stirrup frame depending largely on whether it is being used for sporting, recreational or training activities and also depending on shoe size. Some variations include padding the stirrup for more comfort and better grip as seen in FIGS. 1D-1F. Other variations are of an aesthetic rather than a functional nature. With the above-mentioned variations, the basic components of the frame, i.e. the base, the two bars, and the stirrup hole, remain the same.

Horse-racing stirrups are typically made of stainless steel, aluminum or carbon fiber. Lighter weight material such as aluminum and carbon fiber are more ideal for racing activities.

While riding, jockeys have the challenge of delicately balancing on the horse while skillfully anchoring their boots between the first and third toes in the stirrups. One of the biggest challenges faced by jockeys is to concentrate on this delicate balancing and anchoring act while trying to win a race. The jockey has to maintain a firm footing in the stirrup for the duration of the race. This takes concentration, balance and energy. The jockey has to ensure correct placement of his feet relative to the stirrups in order to achieve the correct riding style and ride effectively. All these factors contribute towards the jockey achieving success in a race. The less the distractions and the less energy expended in balancing body weight, the greater the likelihood of success and a long career in horse-racing.

Sometimes, the rider's boots may slip off a stirrup causing the rider to lose balance and concentration. Other times, the boots may slide too far into the stirrup causing the rider to hurt his toe. These occurrences can happen because of the shape and configuration of the frame, and the fact that there is only one bar to hold the toe box in place.

Therefore, there is a need for an improved stirrup that at least addresses some of the problems associated with conventional stirrups.

SUMMARY

The present invention provides an improved stirrup. Some improvements have been made relative to stirrups to address the problems of safety (e.g. preventing a rider's foot from slipping in the stirrup), to aid in correct foot placement and to make the stirrups more comfortable for the rider. However these improvements accessorize the stirrup in the form of devices attached to the stirrup. The present invention is also different in that it comprises significant functional modifications to the actual configuration of the frame of the stirrup, such modifications serving to achieve the purposes of the invention.

When comparing the present invention to the prior-art, the prior-art has various limitations and does not serve to achieve the primary purpose of the present invention which is to give the rider effective control, proper balancing support and ease in riding derived from using a stirrup which is configured and shaped to ensure firm footing, more comfort, correct foot placement, safety, durability, and effective riding.

In particular, the present invention comprises an additional bar as part of the frame of the stirrup, namely an "extra support bar" serving to support the rider's third toe to the big toe and running at an angle from the platform base to the stirrup hole. The platform base is shaped in the form of the forefoot or the forward portion nearest the toes of a foot which is where the rider positions the toe box of his riding boots. This "sole-shaped" platform base gives extra foot space and comfort to support the first to third toes and toe box of the boot thus enhancing the rider's balance.

The widened platform base also has grooves on the surface which run counter to the direction of the movement of the boots to allow for better grip. The widened base also aims at preventing shin, Achilles tendon, and sole of foot soreness commonly associated with the continued use of the existing stirrups. The stirrup strap hole is positioned at an angle just above the center of the rider's boot to facilitate necessary and skillful maneuvers of the rider. The angle of the hole corresponds with the saddle buckle which is angled by virtue of how the saddle rests on the horse. In traditional stirrups, the stirrup strap hole is not angled; hence, over the course of time, the saddle buckle tends to get worn on one side from riding. The angled stirrup strap hole in the present invention provides for a smoother ride as its angle corresponds to the angle and movement of the saddle bucket during a ride.

The presence and position of the extra support bar, the widened and grooved platform base and the shape and angle of the main stirrup bar give the rider better balance support and ensure firm footing, correct foot placement, correct riding style and ease of riding. The present invention enables the rider to use less energy in balancing his/her body weight, and the present invention also serves to minimize accidents and injuries. Additionally, although specifically designed based on the sport of horse-racing, the present invention can also be adapted for use in related equestrian activities and sports.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1A:
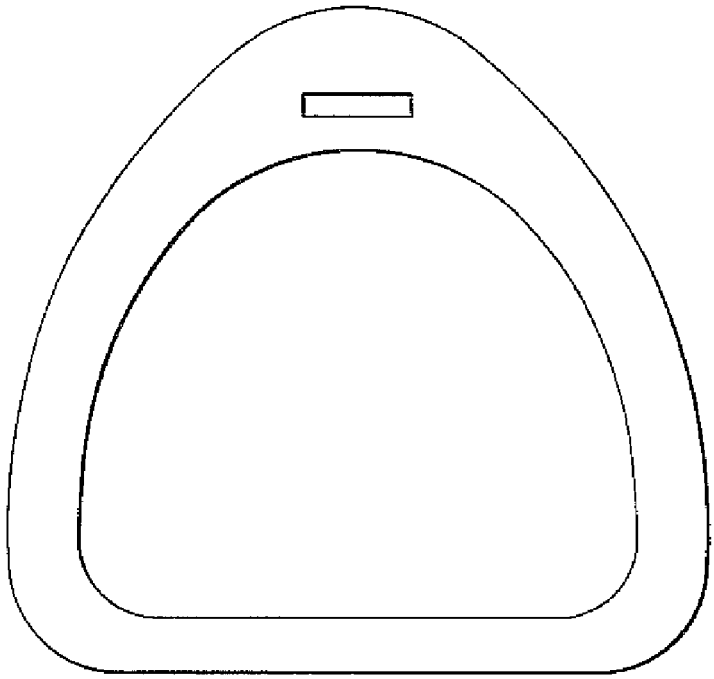
FIG. 1A PRIOR ART
FIG. 1A is a top view of a prior-art stirrup.
Figure 1B:
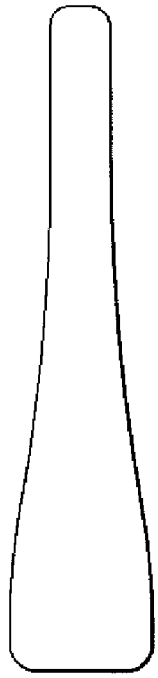
FIG. 1B PRIOR ART
FIG. 1B is a side view of the prior-art stirrup of FIG. 1A.
Figure 1C:
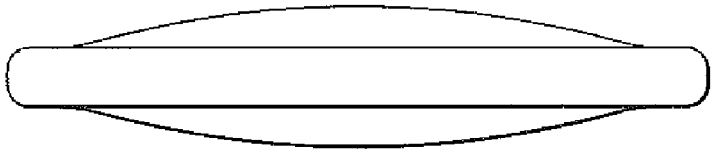
FIG. 1C PRIOR ART
FIG. 1C is a front view of the prior-art stirrup of FIG. 1A.
Figure 1D:
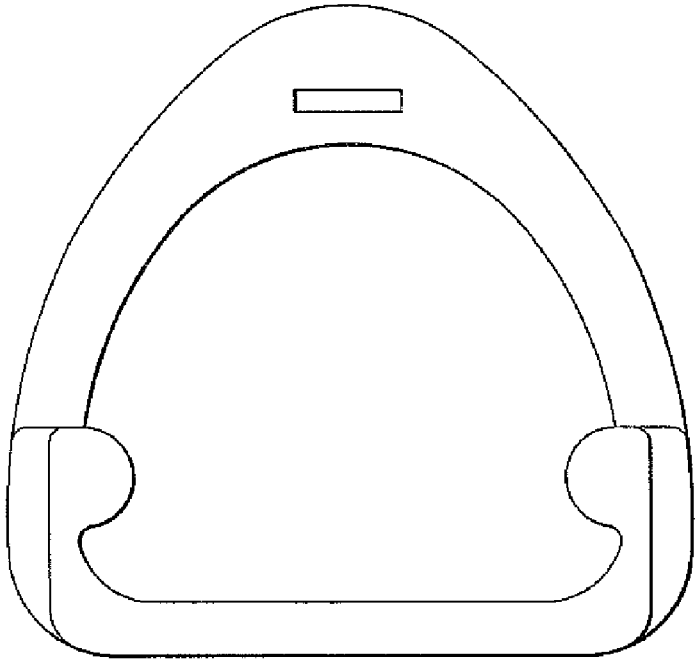
FIG. 1D PRIOR ART
FIG. 1D is a top view of the another prior-art stirrup.
Figure 1E:
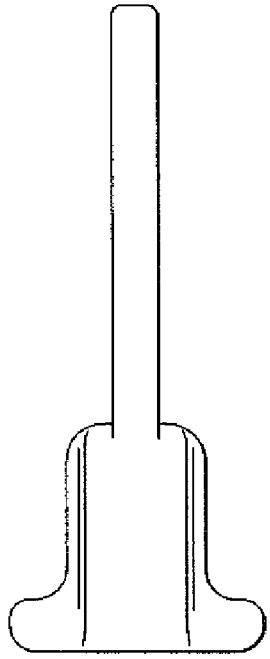
FIG. 1E PRIOR ART
FIG. 1E is a side view of the prior-art stirrup of FIG. 1D.
Figure 1F:
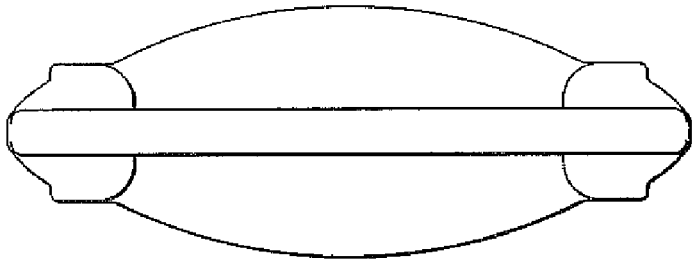
FIG. 1F PRIOR ART
FIG. 1F is a front view of the prior-art stirrup of FIG. 1D.

In the discussion of the FIGURES, the same reference numerals will be used throughout to refer to the same or similar components.

Figure 2:
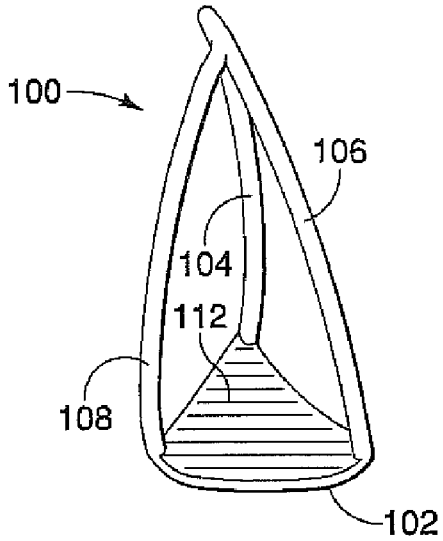
FIG. 2 is an isometric view of a stirrup for the right foot in accordance with a preferred embodiment of the present invention.
Figure 3:
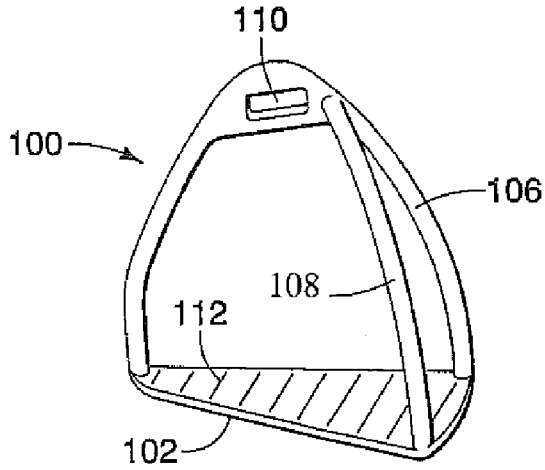
FIG. 3 is a side view of the stirrup of FIG. 2.
Figure 4:
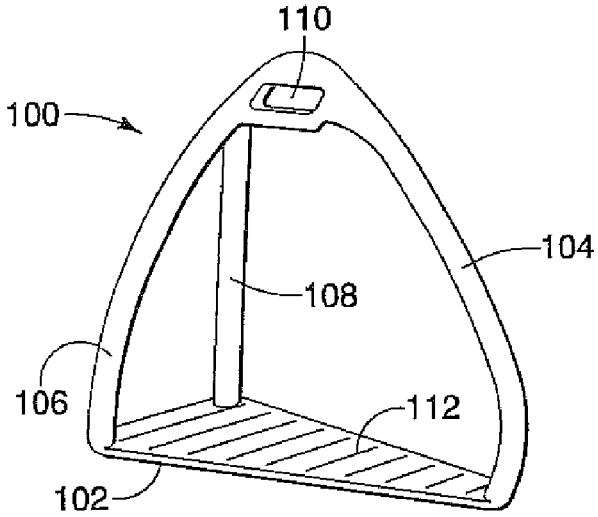
FIG. 4 is a bottom view of the stirrup of FIG. 2.
Figure 5:
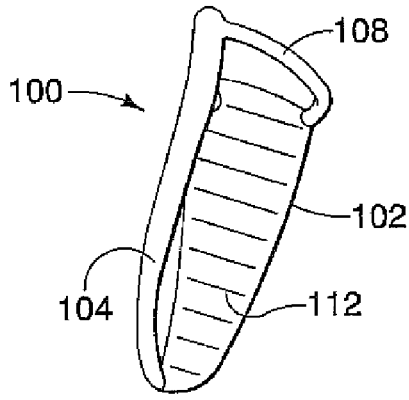
FIG. 5 is a top view of the stirrup of FIG. 2.
Figure 6:
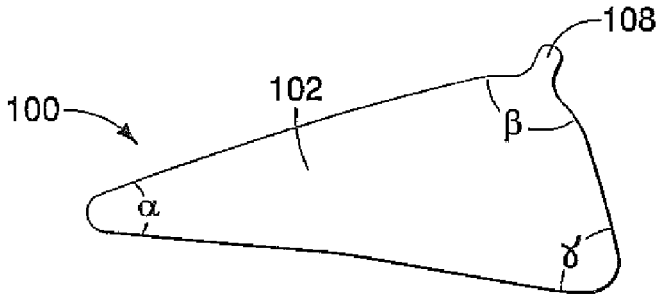
FIG. 6 is a side view of the stirrup of FIG. 2.
Figure 7:
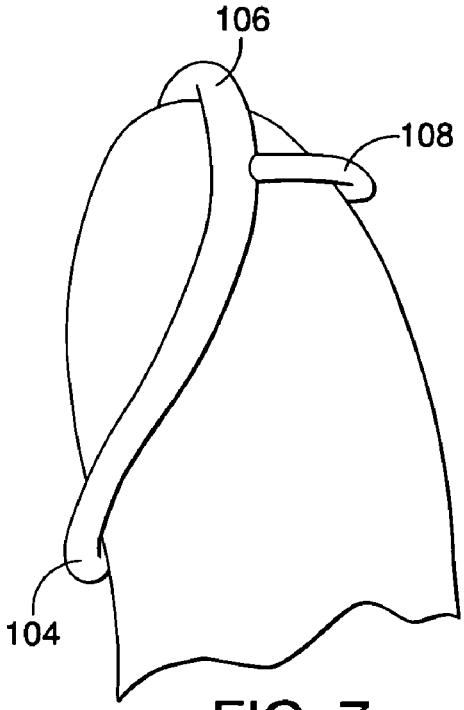
FIGS. 7-9 are top and isometric views of the stirrup of FIG. 2 cradling a right foot.
Figure 8:
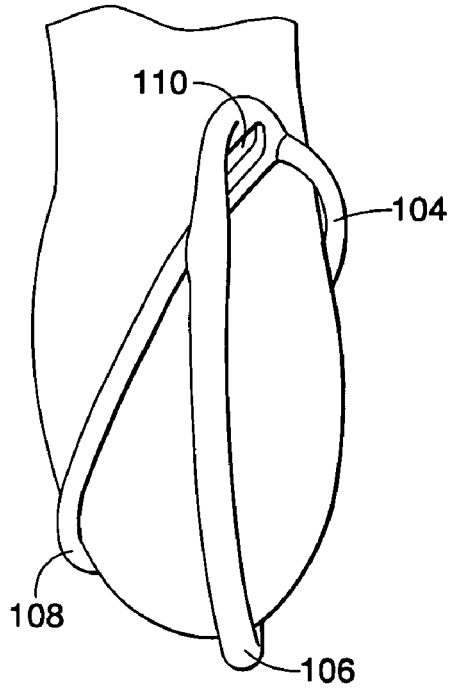
Figure 9:
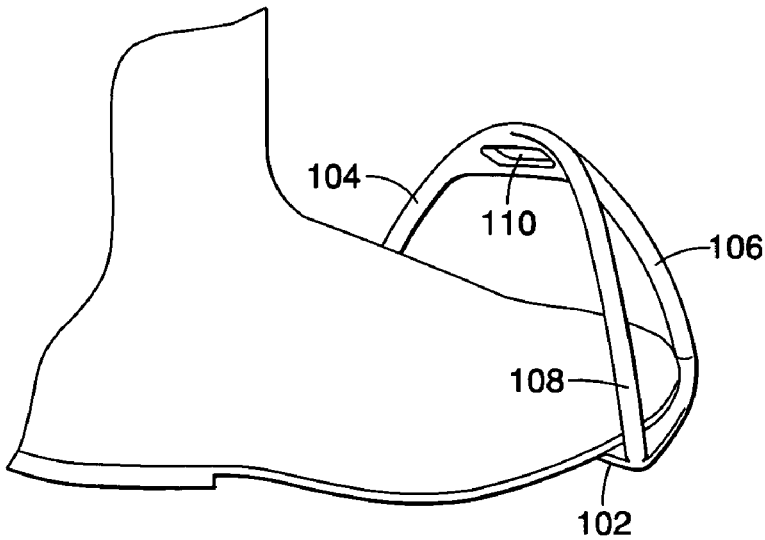

Referring to FIGS. 2-9 of the drawings, the reference numeral 100 generally designates an improved stirrup. As can be seen in FIG. 2-9, the stirrup comprises the following:

a sole-shaped platform base 102, which is grooved;

three support bars or members:

- the first support bar 104 being the main support bar attached to the rear of the platform base;
- the second support bar 106 being attached to the front side of the platform base in the region of the rider's big toe; and
- the third support bar 108 being an extra support bar attached to the front side of the platform base in the region of the rider's third toe; and an angled stirrup strap hole 110.

The platform base 102 is shaped in the form of the forefoot or the forward portion nearest the toes of a foot. Base 102 is the platform on which the rider positions the upper part or toe box of his riding boots. This sole-shaped base 102 provides extra foot space which supports the rider's first and third toes and toe box of the boot. Therefore, the rider is able to gain extra balance while expending less energy, thereby minimizing the energy expended in balancing his or her body weight. The surface of the platform base 102 has grooves 112 running counter to the direction of the movement of the boots to allow for better grip. Additionally, base 102 is preferably an obtuse scalene triangle, wherein the short side of the triangle is located in the forward direction, nearer the horse's head and is the portion of base plate 102 that supports the toes of the rider.

Attached to the base 102 are three support bars 104, 106, and 108. The first or main support bar 104 is attached to the rear of the stirrup 100. Two of the support bars 106 and 108 are attached to the front sides of the stirrup iron. The second support bar 106 is attached in the region of the rider's big toe, and the third support bar 108, herein-described as the 'extra support bar,' is attached in the region of the rider's third toe. The support bars 106, 108 are also referred to as "toe support" bars or members.

All three support bars 104, 106, and 108 have a curve at the base and bend towards the upper part of the stirrup 100 converging into the stirrup strap hole 110. The stirrup strap hole 110 is positioned at an angle above the center of the rider's boot to allow the rider to maneuver skillfully and with ease and comfort while riding and maintaining a firm footing in the stirrup 100. The angle of the stirrup strap hole 110 corresponds with the saddle buckle which is angled by virtue of the saddle resting on the horse. Specifically, the stirrup strap hole 110 is at an angle between about 10° and about 80° relative to a plane that is generally parallel to the base 102.

The main support bar 104, which is the bar that connects to the rear of the stirrup 100 at a vertex having an acute angle $\alpha$, is curved to fit the shape of the inside of the instep to the center of the boot where the angled stirrup hole 110 is located. For a stirrup 100 adapted for use by the right foot, the bar 104 is angled to the left, and for a stirrup 100 adapted for use by the left foot, the bar 104 is angled to the right. Preferably, acute angle $\alpha$ is less than 50°.

The second support bar 106 running from the front of the platform base 102 (and preferably from a vertex having an acute or right angle $\gamma$) converges with the third support bar 108 (i.e. the extra support bar) by the stirrup strap hole 110. For a stirrup 100 adapted for use by the right foot, the bar 106 is connected to the left side of the sole-shaped base 102 at the front. For a stirrup 100 adapted for use by the left foot, the bar 106 connects to the right side of the sole-shaped base at the front. The second support bar 106 runs from the front side of the base almost parallel to the main support bar 104 running from the rear of the base. Preferably acute angle $\gamma$ is less than or equal to 90°.

The third, or extra support bar 108, is positioned approximately 1.8-2 inches from the second support bar (more specifically, to the right of the second support bar 106 for the right foot and to the left of the second support 106 bar for the left foot). Namely, the third support bar 108 is located at the vertex with obtuse angle $\beta$ or between the vertex with acute angle $\gamma$ and the vertex with obtuse angle $\beta$. The distance between the two bars 106 and 108 approximates the distance between the big toe and the third toe of the rider's foot and will vary in approximately quarter inch increments depending on the shoe size. The distance of 1.95 inches between these two bars 104 and 106 as depicted in the FIGS. 2-9 is ideal for large feet. The extra support bar 106 runs at an angle from the base up to the stirrup strap hole 110. The extra support bar 106 is also angled to accommodate the curvature of the foot in the region of the third toe. Preferably, angle $\beta$ is between 90° and 160°.

The three support bars 104, 106, and 108 work in tandem during a race to provide better balance support, enabling the rider to maintain proper balance, pushing force and effective control while riding.

As seen in FIGS. 6-9, for the correct positioning of the rider's feet in accordance with a preferred embodiment of the present invention, the rider places his/her boots in the respective stirrups 100 on either side of the horse with the upper portion of each boot or toe box resting on the sole-shaped platform base 102. The region of the big toe and the third toe of the boot should be anchored between the second support bar over the short side of the base plate and the extra support bar with the space between the bars being between 1.8-2 inches depending on the shoe size. The inner side of the boot in the region of the big toe to the instep is to be anchored between the main support bar 104 (which is curved to the shape of the inside of the instep) and the second support bar.

One objective of the present invention is to give the rider effective control, proper balancing support and ease in riding derived from using a stirrup which is configured and shaped to ensure firm footing, more comfort, correct boot placement, safety, durability, and effective riding. Other objective of the present invention include:

1) Providing the rider with better support on the stirrup
2) Enhancing a jockey's balance and pushing force in a race
3) Minimizing the energy expended by the rider in balancing body weight
4) Enabling the rider to ride with more ease and comfort
5) Aiding in the prevention of shin, Achilles tendon and sole of foot soreness
6) Providing more safety to the rider, with its three support bars instead of the traditional 2 bars
7) Providing a durable stirrup For horse racers, in particular, the invention aims to increase their chances of success in the race by, among other things, minimizing the energy expended by the rider in balancing his or her body weight while riding. The less the distractions and the less energy expended in balancing body weight, the greater the likelihood of success.

The present invention will be of utility to jockeys, other horse riders, and trainers. The invention's simplicity enhances its utility and applicability, particularly for jockeys, due to being light-weight and affordable.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A racing stirrup for use with a racing saddle, the stirrup comprising:

a base plate of generally triangular shape having one short side and a pair of long sides longer than the short side, each of the sides intersecting another at a vertex;

a first toe support member extending upwardly from the base plate at the vertex joining the short side and one of the long sides;

a second toe support member extending from the base plate at the vertex joining the short side and another of the long sides, the second support member joined to the first support member; and a strap aperture formed in one of the support members at a selected location and orientation for attachment of the stirrup to the saddle, wherein, upon attachment of the stirrup to the saddle, the short side of the base plate is oriented in a forward direction closer to the horse's head than either of the long sides, and is configured to support the toes of a rider's foot.

2. The stirrup of claim 1, wherein base plate has an upper and lower side, the upper side being grooved.

3. The stirrup of claim 1, wherein the strap aperture is angled relative to a plane that is generally parallel to the base from about 10° to about 80°.

4. The stirrup of claim 1, further comprising:

a third support member extending upwardly from the base plate at the vertex joining the long sides, the third support member joined to one of the first and second toe support members.

5. The stirrup of claim 1, wherein the vertex joining the long sides is generally opposite the short side and includes an angle of less than about 50°.

6. A racing stirrup for use with a racing saddle, the stirrup comprising:

a generally triangular base plate having three vertices and three sides, a short side of the base plate being shorter in length than the other two sides;

a plurality of support members, at least one of the support members joined to the base plate at each vertex, and the support members extending upwardly and joining one another at a point above the base plate;

a strap aperture formed in one of the support members at a selected location and orientation for attachment of the stirrup to the saddle, wherein, upon attachment of the stirrup to the saddle, the short side of the base plate is oriented in a forward direction closer to the horse's head than either of the long sides, and is configured to support the toes of a rider's foot.

7. The stirrup of claim 6, wherein base plate has an upper and lower side, the upper side being grooved.

8. The stirrup of claim 6, wherein the strap aperture is angled relative to a plane that is generally parallel to the base from about 10° to about 80°.

9. A stirrup for use with a horse-racing saddle, the stirrup comprising:

a generally laminar base member having a triangular periphery defining three sides that join at three vertices, one side being shorter than the other two;

first and second toe support members extending upwardly from the vertices on the shorter side of the base member, the first and second support members joining at a juncture;

a third support member extending from the vertex generally opposite the shorter side of the base member, wherein the third support member intersects the juncture; and a strap aperture formed at the juncture, wherein, upon attachment of the stirrup to the saddle, the shorter side of the base plate is oriented in a forward direction closer to the horse's head than either of the long sides, and is configured to support the toes of a rider's foot.

10. The stirrup of claim 9, wherein base plate has an upper and lower side, the upper side being grooved.

11. The stirrup of claim 9, wherein the strap aperture is angled relative to a plane that is generally parallel to the base from about 10° to about 80°.

12. The stirrup of claim 9, further comprising:

a third support member extending upwardly from the base plate at the vertex joining the long sides, the third support member joined to one of the first and second support members.

13. The stirrup of claim 9, wherein the vertex generally opposite the shorter side includes an angle of less than about 50°.

14. The stirrup of claim 9, further comprising:

a third support member extending upwardly from the base member at the vertex opposite the shorter side, the third support member intersecting the juncture.

* * * * *